US010100684B2

(12) United States Patent
Foster et al.

(10) Patent No.: US 10,100,684 B2
(45) Date of Patent: Oct. 16, 2018

(54) LOW PROFILE SWITCHABLE FINGER FOLLOWER

(71) Applicant: Schaeffler Technologies AG & Co. KG, Herzogenaurach (DE)

(72) Inventors: Colin Foster, Belle River (CA); Faheem Ahmed, Troy, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 78 days.

(21) Appl. No.: 15/233,145

(22) Filed: Aug. 10, 2016

(65) Prior Publication Data

US 2018/0045082 A1 Feb. 15, 2018

(51) Int. Cl.

| | |
|---|---|
| ***F01L 1/34*** | (2006.01) |
| ***F01L 1/20*** | (2006.01) |
| ***F01L 1/047*** | (2006.01) |
| ***F01L 1/18*** | (2006.01) |
| ***F01L 1/46*** | (2006.01) |

(52) U.S. Cl.

CPC ..... *F01L 1/20* (2013.01); *F01L 1/047* (2013.01); *F01L 1/185* (2013.01); *F01L 1/46* (2013.01)

(58) Field of Classification Search

CPC ... F01L 1/20; F01L 1/047; F01L 1/185; F01L 1/46

See application file for complete search history.

(56) References Cited

U.S. PATENT DOCUMENTS

| | | | | |
|---|---|---|---|---|
| 7,278,384 | B2 | 10/2007 | Fernandez et al. | |
| 8,479,694 | B2 | 7/2013 | Manther et al. | |
| 8,733,311 | B2 | 5/2014 | Manther | |
| 2004/0069258 | A1* | 4/2004 | Kaczmarek | F01L 1/185 123/90.16 |
| 2013/0312687 | A1* | 11/2013 | Zurface | F01L 13/0036 123/90.39 |
| 2016/0003111 | A1 | 1/2016 | Evans et al. | |

* cited by examiner

*Primary Examiner* — Zelalem Eshete

(74) *Attorney, Agent, or Firm* — Volpe and Koenig, P.C.

(57) ABSTRACT

A switchable finger follower is provided having an inner lever with a sliding pad located between first and second inner lever ends. The sliding pad has at least one of an anti-friction coating or a surface finish of Ra 0.05 or better forming a cam contact surface. An outer lever supports the inner lever, and includes a first outer lever end mounted for pivoting movement at the first end of the inner lever by a pivot axle. A coupling pin is arranged on one of the inner or outer levers on an end opposite from the pivot axle. The coupling pin has a coupling projection with a first locking surface, and is moveable from a first, locked position with the first locking surface engaged with a second locking surface located on the other of the inner lever or the outer lever, to a second, unlocked position. A lost motion element is arranged between the inner lever and the outer lever.

17 Claims, 2 Drawing Sheets

LOW PROFILE SWITCHABLE FINGER FOLLOWER

BACKGROUND

The present disclosure relates to a switchable finger follower for a valve train of an internal combustion (IC) engine, and more particularly, to a switchable finger follower (SFF) that provides at least two discrete valve lift modes.

Variable valve lift (VVL) systems typically employ a technology in a valve train of an IC engine that allows different engine valve lifts to occur. The valve train is formed of the components that are required to actuate an engine valve, including a camshaft, the gas-exchange valve, and all components that lie in between. VVL systems are typically divided into two categories: continuous variable and discrete variable. Continuous variable valve lift systems are capable of varying a valve lift from a design lift minimum to a design lift maximum to achieve any of several lift heights. Discrete variable valve lift systems are capable of switching between two or more distinct valve lifts. Components that enable these different valve lift modes are often called switchable valve train components. Typical two-step discrete valve lift systems switch between a full valve lift mode and a partial valve lift mode, often termed cam profile switching, or between a full valve lift mode and a no valve lift mode that facilitates deactivation of the valve. Valve deactivation can be applied in different ways. In the case of a four-valve-per-cylinder configuration (two intake+ two exhaust), one of two intake valves can be deactivated. Deactivating only one of the two intake valves can provide for an increased swirl condition that enhances combustion of the air-fuel mixture. In another scenario, all of the intake and exhaust valves are deactivated for a selected cylinder which facilitates selective cylinder deactivation. On most engines, cylinder deactivation is applied to a fixed set of cylinders, when lightly loaded at steady-state speeds, to achieve the fuel economy of a smaller displacement engine. A lightly loaded engine running with a reduced amount of active cylinders requires a higher intake manifold pressure, and, thus, a greater throttle plate opening, than an engine running with all of its cylinders in the active state. Given the lower intake restriction, throttling losses are reduced in the cylinder deactivation mode and the engine runs with greater efficiency. For those engines that deactivate half of the cylinders, it is typical in the engine industry to deactivate every other cylinder in the firing order to ensure smoothness of engine operation while in this mode. Deactivation also includes shutting off the fuel to the dormant cylinders. Reactivation of dormant cylinders occurs when the driver demands more power for acceleration. The smooth transition between normal and partial engine operation is achieved by controlling ignition timing, cam timing and throttle position, as managed by the engine control unit (ECU). Examples of switchable valve train components that serve as cylinder deactivation facilitators include roller finger followers, roller lifters, pivot elements, rocker arms and camshafts; each of these components is able to switch from a full valve lift mode to a no valve lift mode. The switching of lifts occurs on the base circle or non-lift portion of the camshaft; therefore the time to switch from one mode to another is limited by the time that the camshaft is rotating through its base circle portion; more time for switching is available at lower engine speeds and less time is available at higher engine speeds. Maximum switching engine speeds are defined by whether there is enough time available on the base circle portion to fully actuate a coupling assembly to achieve the desired lift mode.

In most IC engine applications, switchable valve train components for cylinder deactivation in an electro-hydraulic system are classified as "pressure-less-locked", which equates to:

a). In a no or low oil pressure condition, the spring-biased coupling assembly will be in a locked position, facilitating the function of a standard valve train component that translates rotary camshaft motion to linear valve motion; and, b). In a condition in which engine oil pressure is delivered to the coupling assembly that exceeds the force of the coupling assembly bias spring, the coupling assembly will be displaced by a given stroke to an unlocked position, facilitating valve deactivation where the rotary camshaft motion is not translated to the valve.

"Pressure-less-unlocked" electro-hydraulic systems can be found in some cam profile switching systems that switch between a full valve lift and a partial valve lift, which equates to:

a). In a no or low oil pressure condition, the spring-biased coupling assembly will be in an unlocked position, facilitating a partial valve lift event; and, b). In a condition in which engine oil pressure is delivered to the coupling assembly that exceeds the force of the coupling assembly bias spring, the coupling assembly will be displaced a given stroke to a locked position, facilitating a full valve lift event.

Many coupling assembly designs utilize a coupling pin that is configured with a locking surface that engages or disengages another locking surface to enable different valve lift modes. In the case of the known switchable roller finger followers, the coupling pin moves longitudinally within a bore of one lever to engage or disengage another lever. In many instances the coupling pin contains a flat locking surface that engages a corresponding flat locking surface.

The known switchable finger followers are switchable roller finger followers having a bearing supported roller as the cam contact surface. This is done to reduce friction. However, in certain applications, space restrictions limit the usability of such switchable roller finger followers. Further, the added weight of a roller follower increases the mass moment of inertia of the finger follower.

SUMMARY

A switchable finger follower is provided having an inner lever with first and second inner lever ends, and a sliding pad located between the first and second inner lever ends. The sliding pad has at least one of an anti-friction coating or a surface finish of Ra 0.05 or better forming a cam contact surface. An outer lever has two outer arms that extend along longitudinal sides of the inner lever, and includes a first outer lever end mounted for pivoting movement at the first end of the inner lever by a pivot axle. A coupling pin is arranged to move longitudinally within a coupling pin bore located on one of the inner lever or the outer lever on an end opposite from the pivot axle. The coupling pin has a coupling projection with a first locking surface. The coupling pin is moveable from a first, locked position with the first locking surface engaged with a second locking surface located on the other of the inner lever or the outer lever, to a second, unlocked position where the first locking surface is not engaged with the second locking surface. A lost motion element is arranged between the inner lever and the outer lever. This arrangement provides a more compact, lighter weight SFF that is suitable for use in reduced operating envelope areas that are more prevalent in today's IC engines.

In one arrangement, the sliding pad includes the anti-friction coating which comprises a DLC coating.

In one arrangement, a height of the inner lever in an area of the sliding pad is in a range of 30% to 50% of a radius of curvature of the sliding pad, More preferably, H is in a range of 45%-50% of the radius of curvature of the sliding pad.

In one arrangement, the inner lever has an I-beam shaped cross-section in an area of the sliding pad, defining two pockets in the inner lever. Preferably, a combined width of the pockets (2*Wp) is at least 4 times a thickness of a web of the I-beam shaped cross-section.

In one embodiment, the first, locked position defines a first valve lift mode and the second, unlocked position defines a second valve lift mode. The first valve lift mode can be a full valve lift mode and the second valve lift mode can be a no valve lift mode. Alternatively, the first valve lift mode can be a high valve lift mode and the second valve lift mode can be a low valve lift mode.

In one embodiment, the second locking surface is located on the inner lever and the coupling pin bore is located on the outer lever.

Preferably, a valve interface configured on the first outer lever end.

In another aspect, a valve train for an internal combustion engine is provided having a camshaft with a cam, at last one engine valve, and a hydraulic pivot element. A SFF with one or more of the above features is located between the camshaft and the engine valve.

Additional aspects of the disclosure that can be used alone or in various combinations are described below and in the claims.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE EXAMPLE EMBODIMENTS

Figure 1:
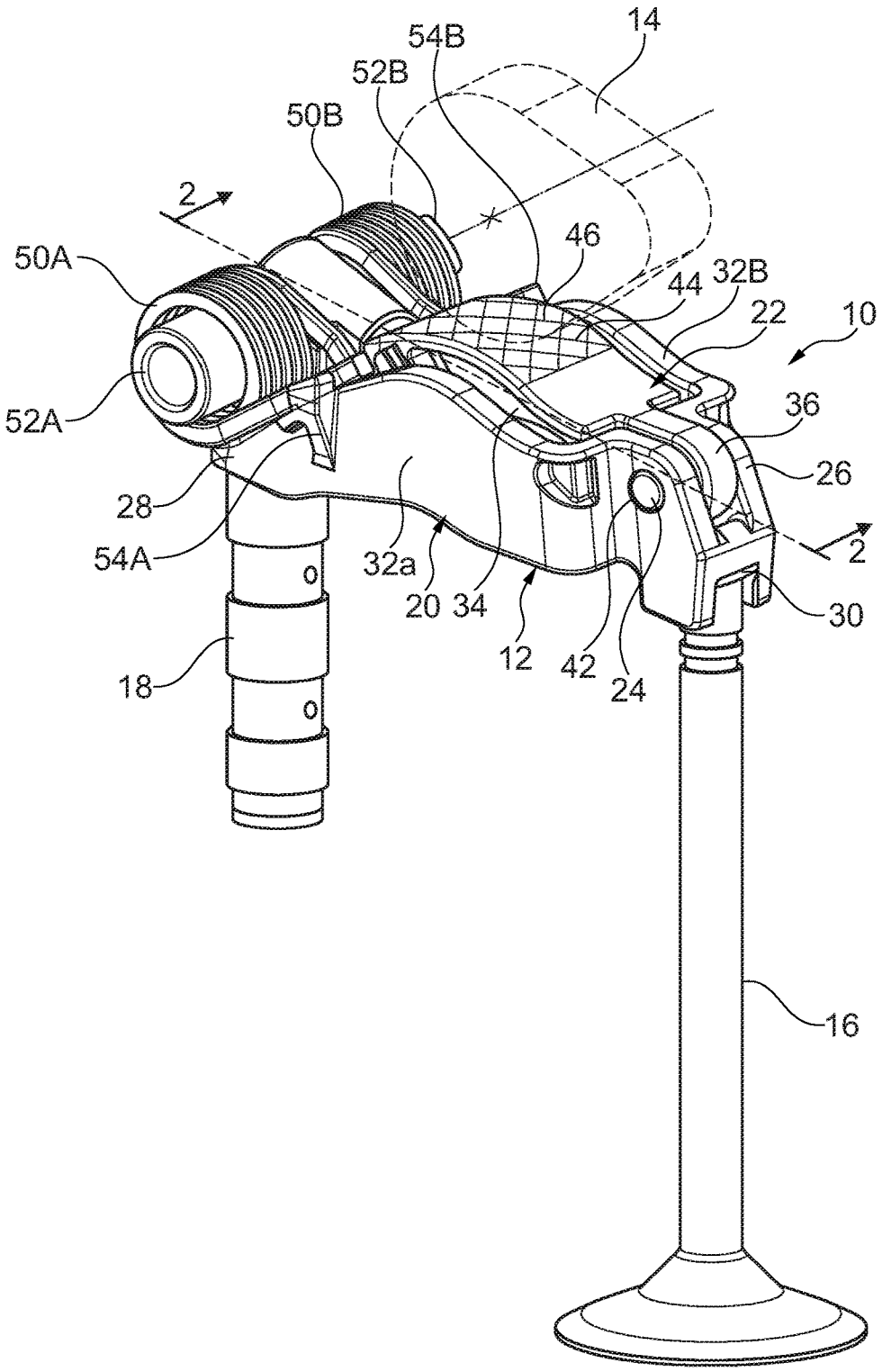
FIG. 1 is a perspective view of a SFF within a valve train system according to a first example embodiment of the disclosure with no valve lift and full valve lift modes of operation.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivatives thereof, and words of similar import.

Referring to FIG. 1, a perspective view of a SFF 12 is shown within a valve train system 10 of an IC engine that includes a camshaft 14, an engine valve 16 and a hydraulic pivot element 18. The camshaft 14 rotationally actuates the SFF 12 to pivot about the hydraulic pivot element 18, causing rotational lift provided by the camshaft 14 to be translated to linear valve lift. The SFF 12 shown in FIG. 1 illustrates one exemplary embodiment of a SFF 12 which will be described in detail with reference to FIGS. 2 through 5.

Figure 2:
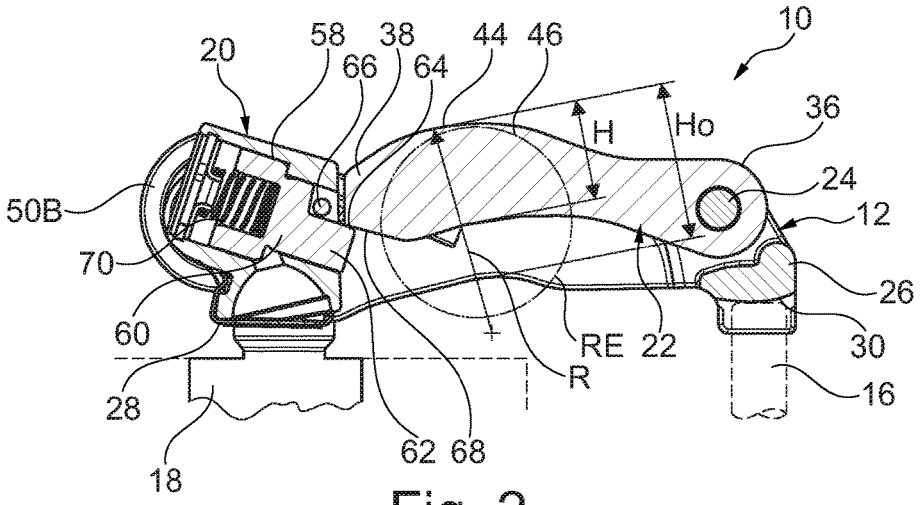
FIG. 2 is a cross-sectional view through the SFF of FIG. 1 taken along line 2-2 in FIG. 1.

As shown in FIGS. 1 and 2 the SFF 12 is comprised of an outer lever 20 attached to an inner lever 22 by pivot axle 24. The outer lever 20 includes first and second outer lever ends 26, 28, with a valve interface 30 located at the first end 26 and a hydraulic pivot element interface 32 at the second end 28. The outer lever 20 has two outer arms 32A, 32B that define a cavity 34 therebetween in a medial region of the outer arm 20, and the inner lever 22 is located in the cavity 34.

The inner lever 22 includes first and second inner lever ends 36, 38, and a first pivot aperture 40 is located at the first inner lever end 36. The outer lever 20 is configured with aligned second and third pivot apertures 42 on the second end 28. The pivot axle 24 shown in FIG. 2 is disposed within the first, second, and third pivot apertures 40, 42 to pivotably connect the inner lever 22 to the outer lever 20.

Figure 3:
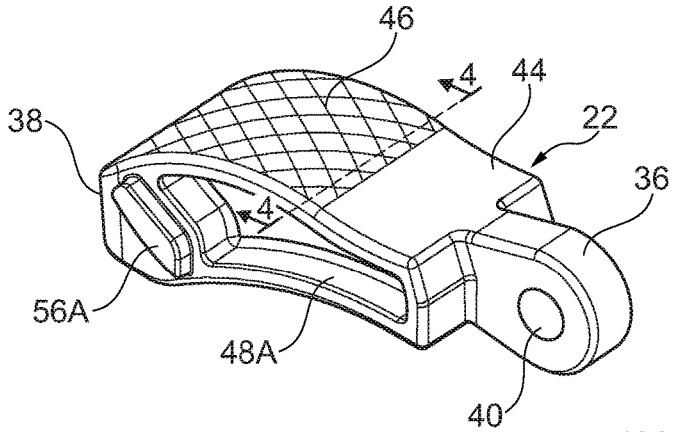
FIG. 3 is a perspective view of the inner lever of the SFF of FIG. 1.

As shown in FIG. 3, the inner lever 22 includes a sliding pad 44 located between the first and second inner lever ends 36, 38. The sliding pad has at least one of an anti-friction coating or a surface finish of Ra 0.05 or better, as indicated at 46, forming a cam contact surface. In one arrangement, the sliding pad 44 includes the anti-friction coating which preferably comprises a diamond-like carbon (DLC) coating 46. This diamond-like carbon (DLC) coating 46 on the sliding pad 44 forms a low friction cam contact surface for the cam. The DLC coating can be in the range of 2-10 μm thick, and is applied in a known manner. Alternatively, a polished finish of Ra 0.05 or better can be used.

As shown in FIG. 2, preferably the sliding pad 44 has a radius of curvature R that is at least 200% larger than an equivalent cam contact roller element, indicated in broken lines as RE, for an equivalent switchable roller finger follower, such as shown in U.S. 2016/0003111, which is incorporated herein by reference as if fully set forth. Additionally, the inner lever 22 has a height in an area of the sliding pad 44 that is 50% or less than a diameter of the cam contact roller element RE of the equivalent switchable roller finger follower. The height H is also preferably in a range of 30% to 50% of the radius of curvature R, and more preferably in a range of 45%-50% of the radius of curvature R. The height H is preferably also less than 75% of a height Ho of the outer lever 20 in an area of the sliding pad 44. More preferably, H is less than 70% of Ho.

Figure 4:
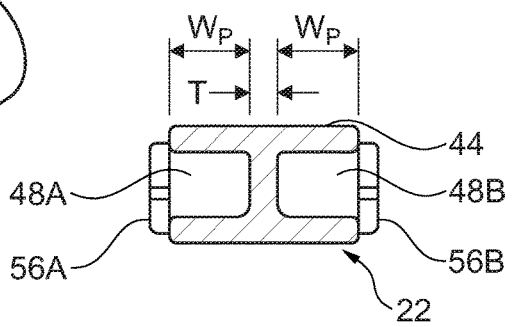
FIG. 4 is a cross-sectional view taken along line 4-4 in FIG. 3.
Figure 5:
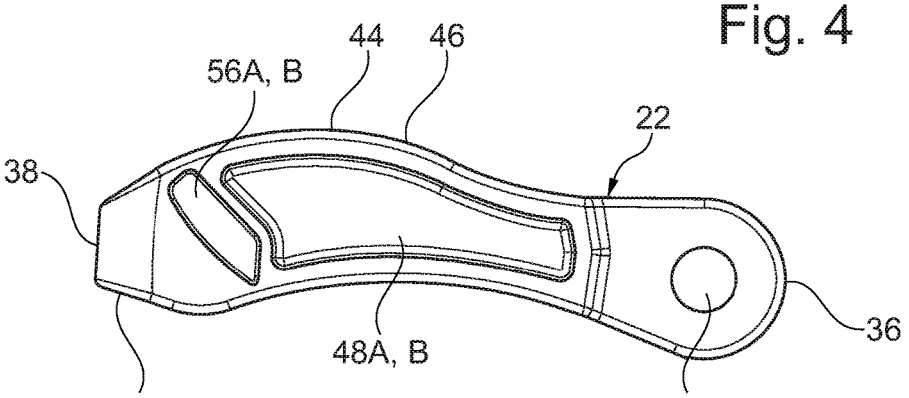
FIG. 5 is a side elevational view of the inner lever of FIG. 3.

As shown in FIGS. 3-5, in the area of the sliding pad 44, the inner lever 22 has an I-shaped cross-section defining two pockets 48A, 48B between the top and bottom flange-sections. The top flange-section forms the sliding pad 44. This arrangement provides reduced weight which reduces the energy required for moving the SFF 12 as well as the inner lever 22 in a lost motion stroke, while still providing the structural stiffness required for the inner lever 22. Here, a combined width of the pockets (2*Wp) is preferably at least 4 times a thickness T of the web.

Referring again to FIG. 1, lost motion resilient elements or springs 50A,50B are arranged on lost motion spring posts 52A, 52B of the outer lever 20. Lost motion spring retainers 54A, 54B on the outer lever 20 ensure containment of the lost motion springs 50A, 50B on their respective lost motion spring posts 52A, 52B during operation. The lost motion springs 50A, 50B are arranged to apply an upward force against lost motion spring landings 56A, 56B located on the inner lever 22 to bias the sliding pad 44 of the inner lever 22 to an upper-most, cam contacting position.

With reference to FIG. 2, the second end 28 of the outer lever 20 is configured with a coupling pin bore 58 that houses a coupling pin 60. The coupling pin 60 is configured with a coupling projection 62. The preferred material of the coupling pin 60 is steel, but other suitable materials are also possible. A first locking surface 64 is configured on the coupling projection 62, preferably as a flat, and also serves as an anti-rotation flat that is guided against a pin 66 in the outer lever 20. A second locking surface 68 is shown on the second end 38 of the inner lever 22, which receives the first locking surface 64 of the coupling projection 62 of the coupling pin 60. The second locking surface 68 is also formed as a flat but can be of any suitable form for such a locking function. This position of the coupling pin 60 defines a first locked position in which a coupling pin bias spring 70 is at a first compressed length. In this first locked position, the inner lever 22 and the outer lever 20 pivot in unison about the hydraulic pivot element 18 (reference FIG. 1), resulting in a full valve lift mode.

The coupling pin 60 is longitudinally displaced within the coupling pin bore 58, defining a second unlocked position in which the coupling bias spring 70 is at a second compressed length. The second compressed length of the second unlocked position is less than the first compressed length of the first locked position such that the first locking surface 64 does not overlap the second locking surface 68. In this second unlocked position, the inner lever 22 is allowed to rotate about the pivot axle 24 during each camshaft rotation, resulting in an arcuate motion of the inner lever 22, often termed lost motion or lost motion stroke.

During this lost motion stroke, the inner lever 22 having the reduced height H can reciprocate up and down in a reduced space in comparison to a switchable roller finger follower, allowing tighter packing due to the reduced clearance requirements to the head, valve springs, spring pallet, etc., allowing the switchable valve function in more compact valve train and engine arrangements. Further, the reduced mass moment of inertia of the inner lever 22 and resultant reduced mass moment of inertial of the SFF 12 offer two advantages: 1). reduced lost motion spring force requirement, and 2). reduced valve spring force requirement; both of which increase the overall efficiency of the valve train.

Having thus described various example embodiments of the present arrangement in detail, it is to be appreciated and will be apparent to those skilled in the art that many physical changes, only a few of which are exemplified in the detailed description above, could be made in the apparatus without altering the inventive concepts and principles embodied therein. The present example embodiments are therefore to be considered in all respects as illustrative and not restrictive, the scope of the embodiments being indicated by the appended claims rather than by the foregoing description, and all changes which come within the meaning and range of equivalency of the claims are therefore to be embraced therein.

LIST OF ELEMENT NUMBERS

10 Valve train system
12 Switchable Finger Follower
14 Camshaft
16 Engine valve
18 Hydraulic pivot element
20 Outer lever
22 Inner lever
24 Pivot axle
26 First outer lever end
28 Second outer lever end
30 Valve interface
32A, 32B Outer lever arms
34 Cavity
36 First inner lever end
38 Second inner lever end
40 First pivot aperture
42 Aligned second and third pivot apertures
44 Sliding pad
46 Surface finish or coating
48A, 48B Pockets
50A, 50B Lost motion resilient elements or springs
52A, 52B Lost motion spring posts
54A, 54B Lost motion spring retainers
56A, 56B Lost motion spring landings
58 Coupling pin bore
60 Coupling pin
62 Coupling projection
64 First locking surface
66 Pin
68 Second locking surface
70 Coupling pin bias spring

What is claimed is:

1. A switchable finger follower comprising:

an inner lever having first and second inner lever ends, a sliding pad located between the first and second inner lever ends, the sliding pad having at least one of an anti-friction coating or a surface finish of Ra 0.05 or better forming a cam contact surface, the inner lever having an I-beam shaped cross-section in an area of the sliding pad, defining two pockets in the inner lever;

an outer lever having two outer arms that extend along longitudinal sides of the inner lever, and a first outer lever end mounted for pivoting movement at the first end of the inner lever by a pivot axle;

a coupling pin arranged to move longitudinally within a coupling pin bore located on one of the inner lever or the outer lever on an end opposite from the pivot axle, the coupling pin having a coupling projection with a first locking surface;

the coupling pin is moveable from a first, locked position with the first locking surface engaged with a second locking surface located on the other of the inner lever or the outer lever, to a second, unlocked position where the first locking surface is not engaged with the second locking surface; and a lost motion element arranged between the inner lever and the outer lever.

2. The switchable finger follower of claim 1, wherein the sliding pad includes the anti-friction coating which comprises a DLC coating.

3. The switchable finger follower of claim 1, wherein a height of the inner lever in an area of the sliding pad is in a range of 30% to 50% of a radius of curvature of the sliding pad.

4. The switchable finger follower of claim 3, wherein the height of the inner lever in the area of the sliding pad is in a range of 45%-50% of the radius of curvature of the sliding pad.

5. The switchable finger follower of claim 1, wherein a combined width of the pockets (2*Wp) is at least 4 times a thickness of a web of the I-beam shaped cross-section.

6. The switchable finger follower of claim 1, wherein the first, locked position defines a first valve lift mode and the second, unlocked position defines a second valve lift mode.

7. The switchable finger follower of claim 6, wherein the first valve lift mode is a full valve lift mode and the second valve lift mode is a no valve lift mode.

8. The switchable finger follower of claim 6, wherein the first valve lift mode is a high valve lift mode and the second valve lift mode is a low valve lift mode.

9. The switchable finger follower of claim 1, wherein the second locking surface is located on the inner lever and the coupling pin bore is located on the outer lever.

10. The switchable finger follower of claim 1, further comprising a valve interface configured on the first outer lever end.

11. A valve train for an internal combustion engine, comprising:

a camshaft with a cam;

an engine valve;

a hydraulic pivot element; and a switchable finger follower located between the camshaft and the engine valve, the switchable finger follower comprising an inner lever having first and second inner lever ends, a sliding pad located between the first and second inner lever ends, the sliding pad having at least one of an anti-friction coating or a surface finish of Ra 0.05 or better forming a cam contact surface on which the cam rides, the inner lever having an I-beam shaped cross-section in an area of the sliding pad, defining two pockets in the inner lever;

an outer lever having two outer arms that extend along longitudinal sides of the inner lever, and a first outer lever end mounted for pivoting movement at the first end of the inner lever by a pivot axle;

a coupling pin arranged to move longitudinally within a coupling pin bore located on one of the inner lever or the outer lever on an end opposite from the pivot axle, the coupling pin having a coupling projection with a first locking surface;

the coupling pin is moveable from a first, locked position with the first locking surface engaged with a second locking surface located on the other of the inner lever or the outer lever, to a second, unlocked position where the first locking surface is not engaged with the second locking surface; and a lost motion element arranged between the inner lever and the outer lever.

12. The valve train of claim 11, wherein the sliding pad includes the anti-friction coating which comprises a DLC coating.

13. The valve train of claim 11, wherein the first outer lever end contacts a stem of the valve.

14. The valve train of claim 11, wherein a second outer lever end is supported on the hydraulic pivot element.

15. The valve train of claim 11, wherein a height of the inner lever in an area of the sliding pad is in a range of 30% to 50% of a radius of curvature of the sliding pad.

16. The valve train of claim 15, wherein the height of the inner lever in the area of the sliding pad is in a range of 45%-50% of the radius of curvature of the sliding pad.

17. The valve train of claim 11, wherein a combined width of the pockets (2*Wp) is at least 4 times a thickness of a web of the I-beam shaped cross-section.

* * * * *